US008065752B2

(12) United States Patent
Kuroda

(10) Patent No.: US 8,065,752 B2
(45) Date of Patent: Nov. 29, 2011

(54) DIVING FACE MASK

(75) Inventor: Yuji Kuroda, Tokyo (JP)

(73) Assignee: Tabata Co., Ltd., Tokyo (JP)

( * ) Notice: Subject to any disclaimer, the term of this patent is extended or adjusted under 35 U.S.C. 154(b) by 88 days.

(21) Appl. No.: 12/318,166

(22) Filed: Dec. 23, 2008

(65) Prior Publication Data

US 2009/0165191 A1 Jul. 2, 2009

(30) Foreign Application Priority Data

Dec. 28, 2007 (JP) ..... 2007-340895

(51) Int. Cl.
*A61F 9/02* (2006.01)
*A61F 9/04* (2006.01)

(52) U.S. Cl. ..... 2/428; 2/441; 2/443

(58) Field of Classification Search ..... 2/248, 430, 2/429, 441, 443
See application file for complete search history.

(56) References Cited

U.S. PATENT DOCUMENTS

| | | | | |
|---|---|---|---|---|
| 3,712,714 | A * | 1/1973 | Uyeda et al. | 359/857 |
| 4,067,069 | A * | 1/1978 | Slosek et al. | 2/441 |
| 4,176,921 | A * | 12/1979 | Matthias | 351/106 |
| 5,329,643 | A * | 7/1994 | Sato | 2/428 |
| 5,363,512 | A * | 11/1994 | Grabos et al. | 2/436 |
| 5,410,763 | A * | 5/1995 | Bolle | 2/436 |
| 5,423,092 | A * | 6/1995 | Kawai | 2/441 |
| 5,819,321 | A | 10/1998 | Wang | |
| 6,243,882 | B1 * | 6/2001 | Kawashima et al. | 2/428 |
| 6,804,835 | B2 | 10/2004 | Chou | |
| 7,290,294 | B2 * | 11/2007 | Kita | 2/443 |
| 7,300,151 | B2 * | 11/2007 | Yee | 351/159 |
| 7,526,813 | B2 * | 5/2009 | Tominaga et al. | 2/13 |
| 2003/0172444 | A1 * | 9/2003 | Banks | 2/443 |
| 2004/0221377 | A1 * | 11/2004 | Banks | 2/443 |
| 2006/0162055 | A1 * | 7/2006 | Kuroda | 2/428 |

FOREIGN PATENT DOCUMENTS

| | | |
|---|---|---|
| GB | 2 423 826 | 9/2006 |
| JP | 8-107948 | 4/1996 |

* cited by examiner

*Primary Examiner* — Bobby Muromoto, Jr.
(74) *Attorney, Agent, or Firm* — Clark & Brody

(57) ABSTRACT

A diving face mask including a pair of front lenses, a lens frame provided with an outer frame having a pair of lens holders in which the lenses are detachably mounted from front and an inner frame having a pair of annular portions adapted to be detachably snap engaged with an inner peripheral surface of the lens holders, a tubular facial skirt extending rearward from the lens frame, and a strap adapted to be put around the wearer's head. The inner frame includes a pair of the integral annular portions and is formed with a space into which a connector member prepared separately of the inner frame is detachably fitted.

2 Claims, 6 Drawing Sheets

DIVING FACE MASK

BACKGROUND OF THE INVENTION

The present invention relates to a diving face mask and more particularly to a diving face mask improved to facilitate lens exchange.

Diving face masks are well known which typically comprises a pair of front lenses, a main frame consisting of a lens frame into which the respective lenses can be fitted at a front portion of the mask and a tubular facial skirt adapted to be held in close contact with a wearer's face at a rear portion of the mask, and a strap adapted to be put around the wearer's head. For example, JP1996-107948A discloses such diving face mask wherein the lens frame comprises an annular outer frame including a pair of lens holders and an annular inner frame adapted to be snap-engaged around respective inner peripheral walls of the lens holders from front after the lenses have been fitted in the lens folders so as to prevent the lenses from falling off.

According to the diving face mask disclosed in JP1996-107948A, the annular inner frame is formed with a space so that the inner frame is partially discrete in the circumferential direction. Such construction allows the inner frame to be easily disengaged from the outer frame by deforming the space radially inward with the peripheral edge of the space held by the fingers. However, in view of the circumferentially discrete inner frame, the inner frame should be elastically deformed to be bent due to any high impact exerted externally on the lens frame during use of the mask and released from the snap engagement with the outer frame. Eventually, the inner frame should fall off together with the lens from the mask.

SUMMARY OF THE INVENTION

It is an object of the present invention to provide the diving face mask improved so that the inner frame can be protected from being deformed during use of the mask and, when it is necessary to disassemble the mask, for example, to exchange the lens, the inner frame can be rather easily detached merely by elastically deforming the inner frame without use of a specific tool.

According to the invention, there is provided a diving face mask comprising a pair of front lenses, a lens frame including of an outer frame having a pair of lens holders adapted to receive the lenses detachably mounted therein from front and an inner frame having a pair of annular portions adapted to be detachably snap engaged with an inner peripheral surface of the lens holders, a tubular facial skirt extending rearward from the lens frame, and a strap adapted to be put around the wearer's head.

The improvement according to the present invention lies in that the inner frame comprises a pair of the integral annular portions and is formed with a space adapted to receive a connector member prepared separately of the inner frame detachably fitted therein.

The present invention includes preferred embodiments as follow:

(1) The space is formed in a middle portion of the inner frame defined between the pair of annular portions and the connector member comprises a front portion partially defining a front surface of a middle portion of the inner frame and a rear portion extending rearward from the front portion so that the rear portion is inserted into a through-hole formed in a middle portion defined between the pair of lens holders of the outer frame to fit the connector member into the lens frame in a detachable manner.

(2) The connector member is formed on a rear end of the rear portion with a latching detent projecting downward.

In the case of the diving face mask according to the present invention, when it is desired to disassemble the mask, for example, to exchange the lenses, the upper portion of the inner frame can be elastically deformed by pushing the upper portion of the inner frame toward the space and thereby the snap engagement between the outer frame and the inner frame can be easily released without use of any specific tool. In addition, the inner frame should not be elastically deformed and consequently the inner frame should not fall off together with the lenses from the mask since the connector member is fitted into the space of the inner frame.

DETAILED DESCRIPTION OF THE PREFERRED EMBODIMENTS

Details of a diving face mask according to the present invention will be more fully understood from the description of an embodiment thereof given hereunder with reference to the accompanying drawings.

Figure 1:
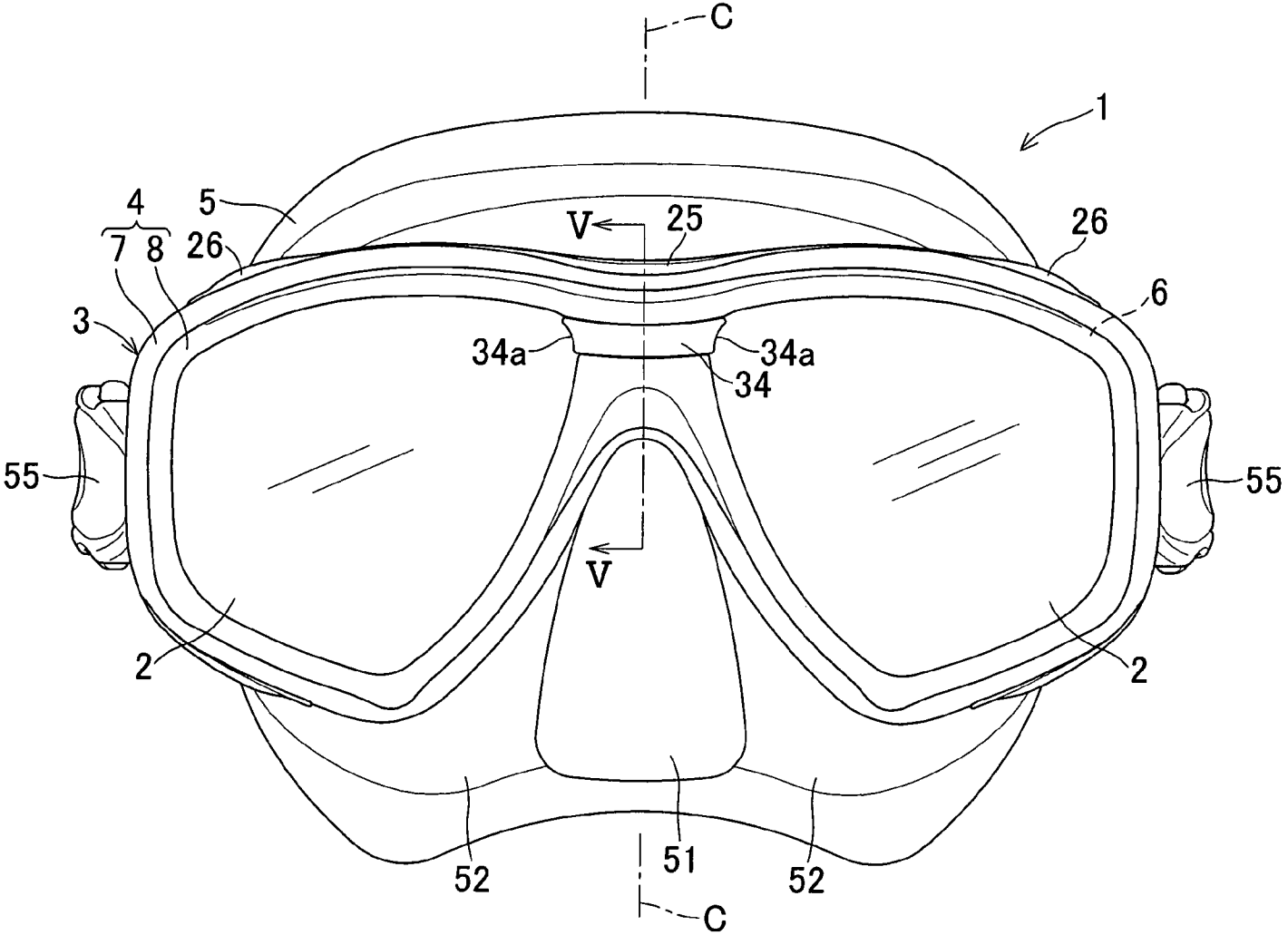
FIG. 1 is a front view of a diving face mask.
Figure 2:
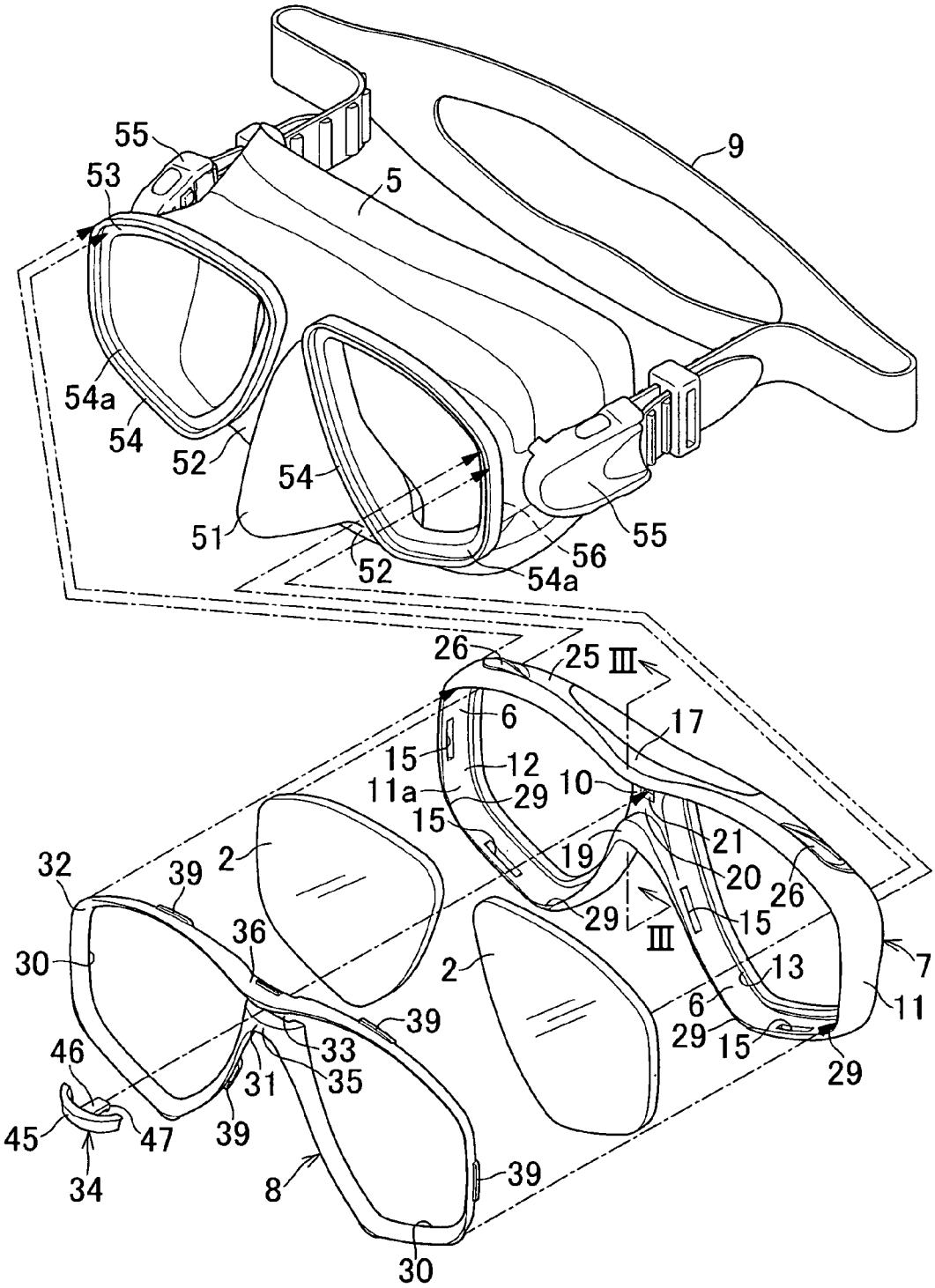
FIG. 2 is a partially exploded perspective view showing the mask of FIG. 1.
Figure 3:
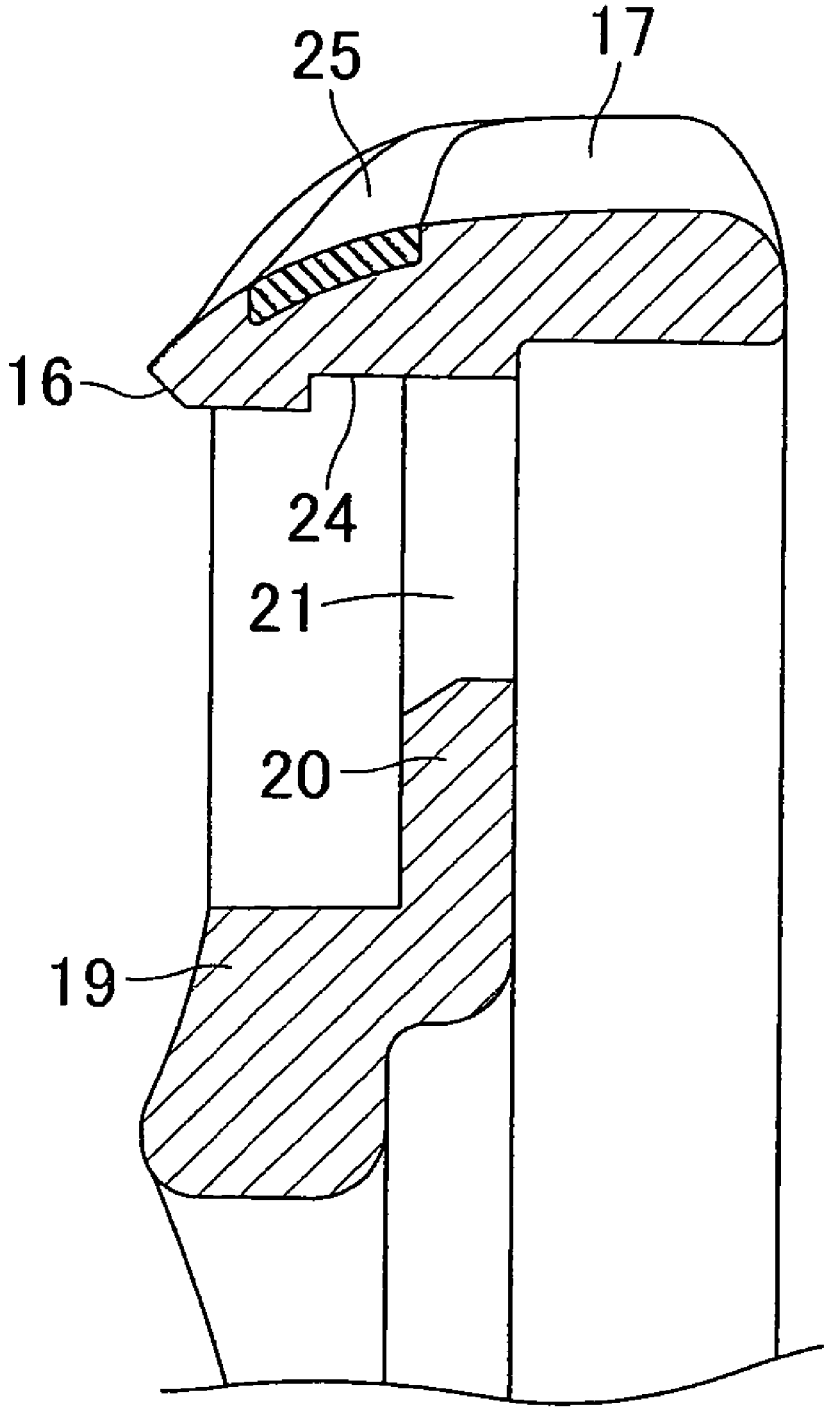
FIG. 3 is a sectional view taken along the line III-III in FIG. 2, showing an outer frame.

FIG. 1 is a front view of the diving face mask 1, FIG. 2 is a partially exploded perspective view showing the mask 1 of FIG. 1 and FIG. 3 is a sectional view taken along the line III-III in FIG. 2.

The mask 1 is bilaterally symmetric about a center line C-C and comprises a pair of front lenses 2, a main frame 3 adapted to fit respective front surfaces of these lenses and to hold them in close in contact with a wearer I f ace, and a strap attached to the main frame 3 and adapted to be put around the wearer's head.

The lenses 2 may be made of a plastic material or glass material and detachably mounted on the main frame 3 in a water-tight manner.

The main frame 3 comprises a plastic lens frame 4 and a rubber tubular facial skirt 5 extending rearward from the rear surface of the lens frame 4. The lens frame 4 comprises, in turn, an outer frame 7 having a pair of lens holders 6 and an inner frame 8 adapted to be engaged with an inner peripheral surface 11*a* of the outer frame 7 from the front side so as to prevent the lenses 2 from falling off. The outer frame 7 is made of plastic material having a relative high rigidity and substantially deformation-resistance while the inner frame 8 is also made of a somewhat soft plastic material and, as will be described later in more detail, partially cut off to form a space 33 allowing the inner frame to be deformed in a vicinity of the space 33.

As will be apparent from FIGS. 2 and 3, the outer frame 7 comprises a pair of the bilaterally symmetric annular lens holders 6, a middle portion 10 interposed between these lens holders and a peripheral wall 11 extending in a front-to-rear direction so define the periphery of the lens holders 6. Respective inner peripheral walls of the lens holders 6 at rear ends thereof project radially inward and respective inner edges thereof are formed with annular ribs 13. An inner peripheral surface 11*a* of the peripheral wall 11 is formed at predetermined positions aside forward with a plurality of substantially rectangular engagement recesses 15 at intervals in a circumferential direction. The lens folders 6 are respectively formed at bottom corners with guide recesses 29 extending along front edges. In the middle portion 10, a recess 20 is defined between an upper portion 17 of the peripheral wall 11 curving downward so as to extend forward and having a convex edge 16 extending downward, and a generally invert V-shaped lower portion 19 of the peripheral wall 11 extending forward along a nose cover 51 of the facial skirt 5 by substantially the same dimension as the upper portion 17. The recess 20 includes a generally T-shaped through-hole 21 and the inner surface of the peripheral wall 11 is formed in a region aligned with the through-hole 21 with an engagement groove 24 which is concave upward. The upper portion 17 of the peripheral wall 11 is provided on its outer surface with a cover member 25 of rubber curving so as to be convex forward and attached thereon from above. The cover member 25 is formed in a vicinity of transversely opposite ends thereof with projections 26 directed upward.

Figure 4:
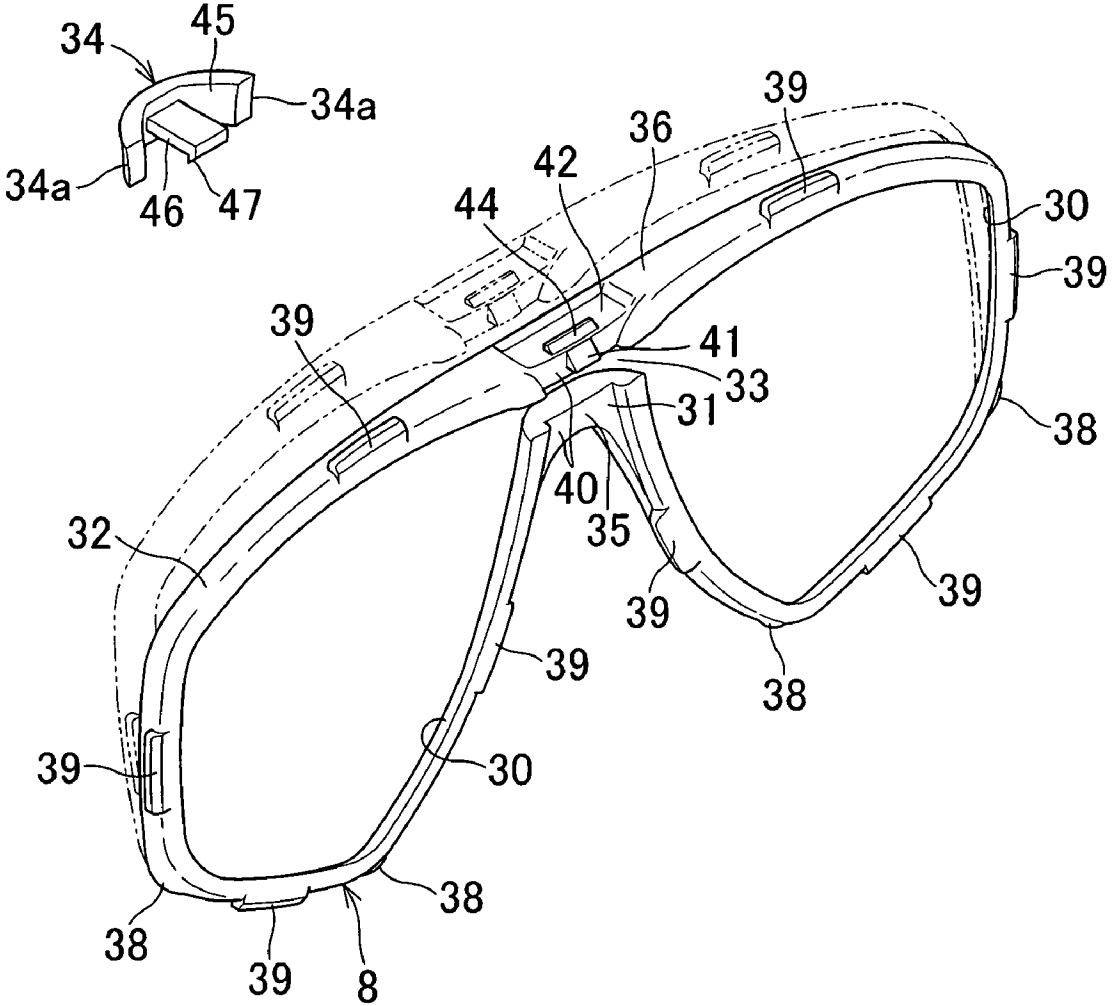
FIG. 4 is a rear view of an inner frame.

FIG. 4 is a rear view of the inner frame 8.

The inner frame 8 comprises a pair of annular portions 30, a middle portion 31 extending between the annular portions 30, and a peripheral wall 32 defining a contour of the annular portions 30 and extending in the front-to-rear direction. The middle portion 31 is discrete in a vertical direction, i.e., divided into a lower half 35 having a generally invert V-shape following the lower portion 19 of the outer frame 7 and an upper half 36 curved to be convex downward. As will be apparent from FIG. 1, in an assembled state, a connector member 34 has been detachably fitted into the space 33 from front. The peripheral wall 32 is formed along a rear edge of its outer peripheral surface with engagement projections 39 at intervals in the circumferential direction so as to be operatively associated with the engagement recesses 15 of the outer frame 7. Each of the annular portions 30 is provided at corners of its bottom with relatively thin projections 38 so as to be operatively associated with the guide recesses 29 of the outer frame 7 and the peripheral wall 32 as a whole slightly slopes radially inward so as to be easily fitted to the inner peripheral surface 11*a* of the outer frame 7. The upper and lower halves 36, 35 of the middle portion 31 divided by the space 33 are respectively formed with recesses 40 which are concave forward wherein the recess 40 of the upper half 36 has a projection 41 extending rearward and a rear surface of this projection 41 slightly slopes rearward. The upper half 36 of the middle portion 31 is formed on its outer surface with an engagement recess 42 which is concave downward and this engagement recess 42 is formed along its rear edge with a latching detent 44 of which the rear surface slightly slopes rearward.

The space 33 formed in the middle portion 31 of the inner frame 8 enables the upper portion 17 of the peripheral wall 11 to be elastically deformed so as to be bent toward the space 33, i.e., downward. The upper portion 17 of the peripheral wall 11 can be elastically deformed forward also as indicated by imaginary lines in FIG. 4 by exerting a force directed forward on the upper portion 17.

The connector member 34 is made of a hard plastic material and comprises a circular arc-shaped front portion 45 partially defining the front surface of the middle portion 31 of the inner frame 8 and a straight rear portion 46 adapted to be inserted into the through-hole 21 of the outer frame 7 wherein the rear portion 46 is provided on its rear end with a latching detent 47 extending downward. Transversely opposite ends 34a of the front portion 45 slightly project radially inward with respect to the annular portions 30 (See FIG. 1) as viewed in a state of the connector member 34 fitted into the lens frame 3 so that the wearer can take these ends 34a between the fingers of the wearer and smoothly detach the connector member 34 from the mask 1.

Referring again to FIGS. 1 and 2, the facial skirt 5 is provided centrally on its front region with the nose cover 51 adapted to cover the wearer's nose, nose holding recesses 52 formed on both sides of the nose cover 51 into which the wearer can insert the fingers of the wearer externally and a pair of annular seals 53 adapted to hold the main frame 3 in a water-tight manner. Each of the seals 53 is formed along an inner peripheral portion with an annular flange 54 and the seal 53 is attached to the outer frame 7 from rear side with a rear surface 56 of the flange 54 put in contact with the rib 13 of the outer frame 7. The peripheral edge of the lens 2 may be brought into contact with a front surface 54a of the flange 54 to fit the lens 2 to the seal 53 and the inner frame 8 may be brought into contact with the inner peripheral surface 11*a* to achieve a snap engagement between the engagement projections and the engagement recesses 15. In this way, the lens 2 is tightly held between the inner frame 8 and the seal 53 and thereby the lens 2 can be held by the lens frame 3 in a water-tight fashion.

The facial skirt 5 is provided on both sides thereof with strap adjusters 55 by means of which the strap 9 extend rearward from the both sides of the facial skirt 5.

Figure 5:
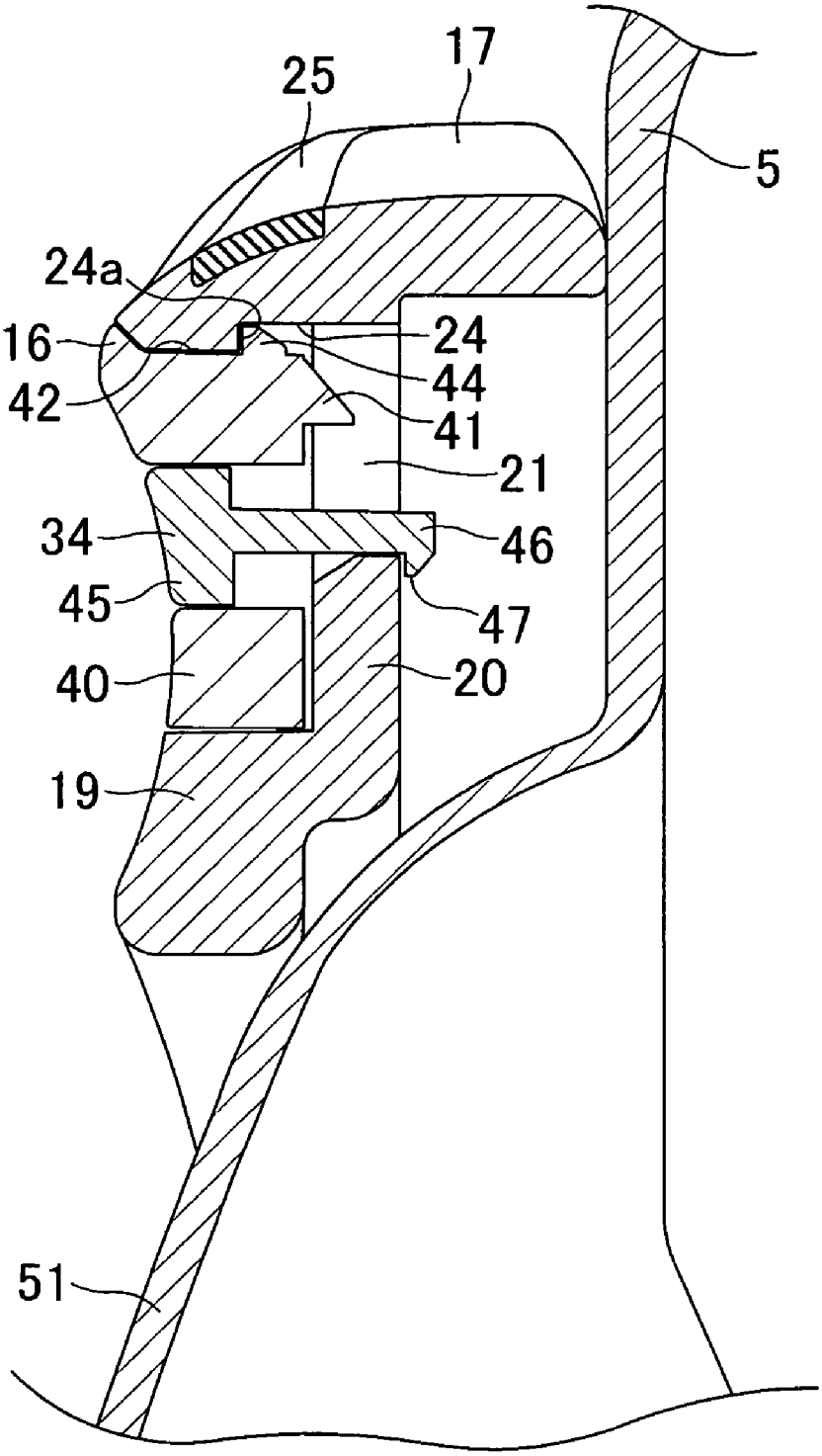
FIG. 5 is a sectional view taken along the line V-V in FIG. 1.
Figure 6:
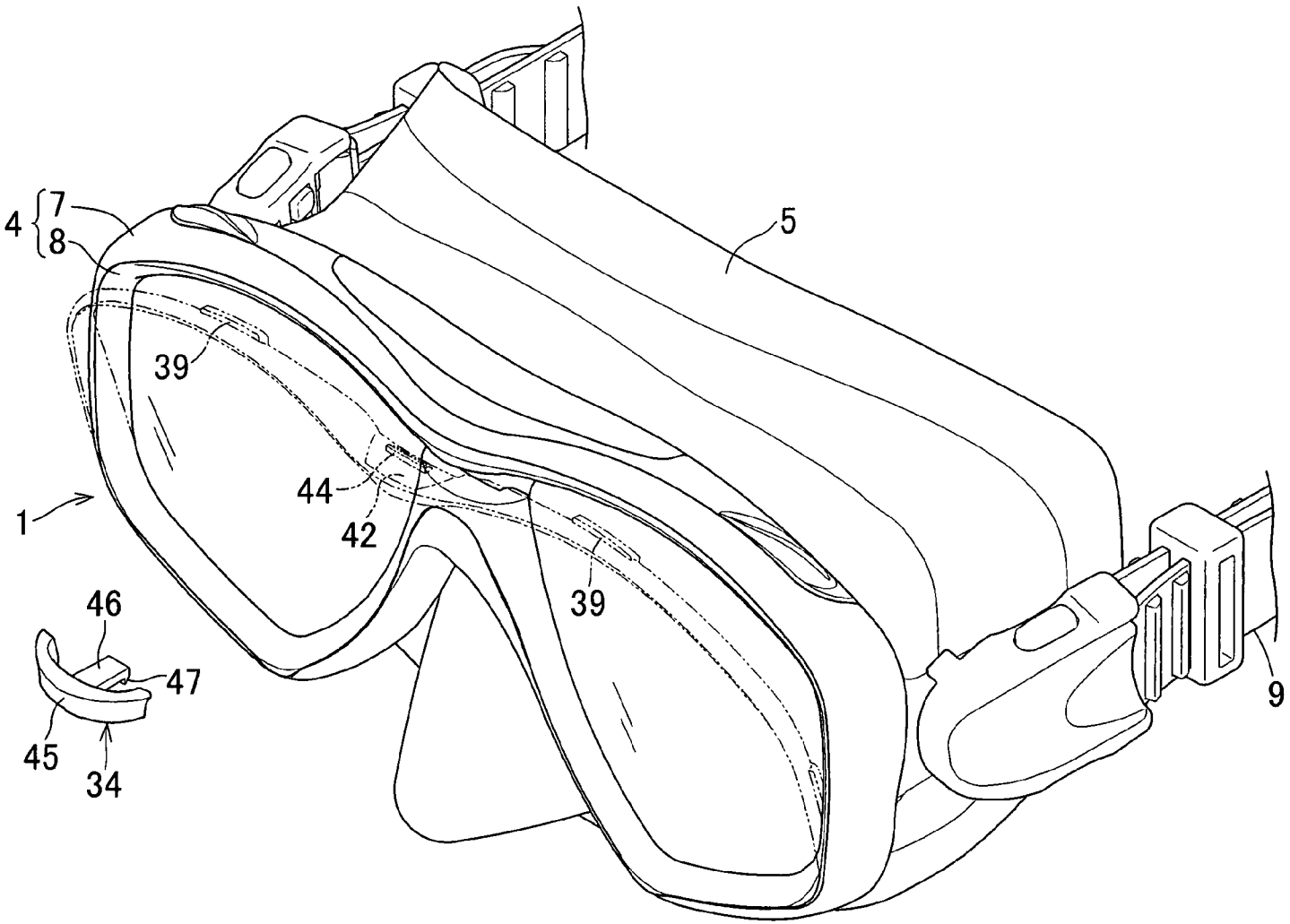
FIG. 6 is a perspective view partially illustrating procedures of disassembling the mask of FIG. 1.

FIG. 5 is a sectional view taken along the line V-V in FIG. 1 and FIG. 6 is a perspective view partially illustrating procedures of disassembling the mask of FIG. 1.

To assemble the mask 1 of the construction as has been described above, the seals 53 of the facial skirt 5 may put into the lens holders 6 from behind the outer frame 7 until the respective rear surfaces 56 of the flanges 54 come in contact with the ribs 13 and the seals 53 are fitted to the lens holders 6, then the lenses 2 are fitted to the seals 53 within the lens holders 6 from front so that the respective peripheral edges of the lenses 2 may come in contact with the respective front surfaces 54*a* of the flanges 54. Now the recess 42 formed on the outer surface of the upper half 36 of the inner frame 8 is engaged with the convex edge 16 of the outer frame 8, the latching detent 44 is engaged with the front edge 24*a* of the groove 24, the recess 40 of the inner frame 8 is brought into contact with the front surface of the recess 20 of the outer frame 7, the peripheral wall 32 of the inner frame 8 is brought into contact with the inner peripheral surface 11*a* of the outer frame 7 and the engagement projections 39 are snap-engaged with the engagement recesses 15. Thereafter the connector member 34 is inserted into the space 33 of the inner frame 8 until the rear portion 46 of the connector member 34 is completely inserted into the through-hole 21. In the mask 1 assembled in this manner, the lenses 2 are held in the lens frame 3 in a water-tight fashion and therefore the lenses 2 should not be displaced and/or fall off from the lens frame 3. Even if a force directed forward and biasing the connector member 34 to be fallen off is exerted on the connector member 34 during use of the mask, the latching detent 47 engaged with the rear surface of the recess 20 of the outer frame 7 prevents the connector frame 34 from being unintentionally fallen off.

While procedures of disassembling the mask 1 basically follow the procedures of assembling the mask 1, now the steps to be followed until the inner frame 8 is disassembled from the mask 1 will be described here. First, a central region of the facial skirt 5 extending between the seals 53 covering the rear side of the outer frame is turned down-/rearward to expose the through-hole 21 of the outer frame 7. Then the rear end of the rear portion 46 of the connector member 34 is pushed up-/forward until the effect of the latching detent 47 is released and the connector member 34 is detached from the lens frame 3. In this step, the wearer's finger or a thin rod or the like may be inserted between the facial skirt 5 and the outer frame to push out the connector member 34. Alternatively, after the effect of the latching detent 47 has been released, the transversely opposite ends 34*a* of the connector member 34 projecting radially inward with respect to the annular portions 30 may be taken between the fingers of the wearer and then the connector member 34 may be detached from front, as has been described above. Then the rear surface of the projection 41 provided within the through-hole 21 may pushed down-/forward and thereby the upper half 36 of the inner frame 8 are elastically deformed wholly to be bent downward to disengage the engagement recess 42 from the convex edge 16 and simultaneously to release the latching detent 44 from the front edge 24*a* so that the upper half 36 can be pushed forward from the outer frame 7. Thereafter the upper half 36 having been pushed forward in this manner may be held by the fingers of the wearer and pulled forward to release successively the snap engagement between the engagement projections 39 and the associated engagement recesses 19 and thereby to detach the inner frame 8 from the outer frame 7.

When it is desired to disassemble the mask 1, for example, to exchange the lenses, the presence of the space 33 formed in the middle portion 31 of the inner frame 8 has an important function. Specifically, the upper portion 26 of the inner frame can be elastically deformed by pushing the upper portion 26 of the inner frame toward the space 33 and thereby the snap engagement between the outer frame 7 and the inner frame 8 can be easily released without use of any specific tool. In addition, even if a high impact is exerted on the lens frame 3 during use of the mask 1, the inner frame 8 should not be elastically deformed and consequently the inner frame 8 should not fall off together with the lenses 2 from the mask 1 since the connector member 34 is fitted into the space 33 of the inner frame 8. While the space 33 is formed in the middle portion 31 of the inner frame 8 according to the illustrated embodiment, it is possible to form the space 33 in a suitable region of the annular portions 30 or formed in a plurality of desired regions of the inner frame 8 so far as the inner frame 8 can be elastically deformed radially of the inner frame 8.

The entire discloses of Japanese Patent Application No. 2007-340895 filed on Dec. 28, 2007 including specification, drawings and abstract are herein incorporated by reference in its entirety.

What is claimed is:

1. A diving face mask comprising:

a pair of front lenses;

a lens frame including of an outer frame having a pair of lens holders adapted to receive said lenses detachably mounted therein from front and an inner frame having a pair of annular portions adapted to be detachably snap engaged with an inner peripheral surface of said lens holders;

and a tubular facial skirt extending rearward from said lens frame, and a strap adapted to be put around the head of a wearer; wherein said inner frame comprises a pair of said integral annular portions and is formed with a space adapted to receive a connector member prepared separately of said inner frame detachably fitted therein, wherein said space is formed in a middle portion of said inner frame defined between said pair of annular portions and said connector member comprises a front portion partially defining a front surface of said inner frame's middle portion and a rear portion extending rearward from said front portion so that said rear portion is inserted into a through-hole formed in a middle portion defined between said pair of lens holders of said outer frame to fit said connector member into said lens frame in a detachable manner.

2. The mask according to claim 1, wherein said connector member is formed on a rear end of said rear portion with a latching detent projecting downward.

* * * * *